United States Patent [19]

Ruggeri

[11] 4,370,955

[45] Feb. 1, 1983

[54] ROTARY VALVE FOR AN INTERNAL COMBUSTION ENGINE

[76] Inventor: John R. Ruggeri, 79 Apple Valley Rd., Stamford, Conn. 06903

[21] Appl. No.: 38,280

[22] Filed: May 11, 1979

Related U.S. Application Data

[63] Continuation-in-part of Ser. No. 21,444, Mar. 19, 1979, abandoned.

[51] Int. Cl.[3] ..... F01L 7/00

[52] U.S. Cl. ..... 123/190 BB; 123/190 BA; 123/190 E

[58] Field of Search ..... 123/80 R, 80 BA, 190 R, 123/190 B, 190 BA, 190 BB, 190 BD, 190 E

[56] References Cited

U.S. PATENT DOCUMENTS

| | | | |
|---|---|---|---|
| Re. 17,692 | 6/1930 | Wickersham . | |
| 1,303,654 | 5/1919 | Gove | 123/80 BA |
| 1,425,381 | 8/1922 | Gueret | 123/80 BA |
| 1,754,019 | 4/1930 | Holmes | 123/190 BB |
| 2,048,134 | 7/1936 | Montalto . | |
| 2,459,973 | 1/1949 | Stevens | 123/190 E |
| 2,730,088 | 1/1956 | Hyde . | |
| 3,892,220 | 7/1975 | Franz | 123/190 R |
| 4,019,487 | 4/1977 | Guenther | 123/190 E |
| 4,134,381 | 1/1979 | Little | 123/80 BA |

*Primary Examiner*—Craig R. Feinberg

*Assistant Examiner*—W. R. Wolfe

*Attorney, Agent, or Firm*—Brumbaugh, Graves, Donohue & Raymond

[57] ABSTRACT

A rotary valve for an internal combustion engine comprises an outer stationary support member formed with a hollow interior, an inner valve member housed within the hollow interior, and bearing means supporting the valve member for rotation about an axis at one-half or one-quarter engine speed, depending on the embodiment. The outer support member and the inner rotatable member are formed with port and duct means of various configurations for selectively enabling and preventing the flow of intake and exhaust gases through the valve in accordance with the angular position of the inner rotatable member with respect to the outer support member. Annular and strip seals are mounted between opposing surfaces of the outer support member and the inner rotatable member to prevent leakage of gas therebetween. A portion of the duct means formed in the outer support member serves also as a portion of the combustion chamber. Impeller means is mounted within the portion of the duct means formed within the inner rotatable member for producing a mixing and supercharging effect upon rotation of the inner rotatable member. The relative arrangement of the valve bearings and of collector and distribution pieces facilitates cooling and lubrication.

19 Claims, 14 Drawing Figures

ROTARY VALVE FOR AN INTERNAL COMBUSTION ENGINE

CROSS REFERENCE TO RELATED APPLICATION

This is a continuation-in-part of applicant's copending application Ser. No. 21,444, filed Mar. 19, 1979, for Rotary Valve For An Internal Combustion Engine, now abandoned.

BACKGROUND OF THE INVENTION

This invention relates to rotary valves for internal combustion engines and, more particularly, to a novel and highly-effective rotary valve characterized by (a) side-face seals of superior sealing ability, (b) longitudinal strip seals that are individually straight despite the angular offset of the valve from one cylinder to the next, (c) a duct portion that serves also as a portion of the combustion chamber and that produces a "squish" effect during the compression stroke, whereby greater turbulence of the fuel-air mixture and better burning are achieved, (d) impeller blades within the rotating part of the valve for producing a mixing and supercharging effect, and (e) exceptional durability and efficiency.

Rotary valves for internal combustion engines have long been known. They have certain obvious advantages as compared to poppet valves. Poppet valves have a reciprocating motion, which is a great drawback during high-speed operation. The inertia of a poppet valve can be reduced by making the valve lighter, but only to a point. The valve must have a certain minimum size (diameter, rise and thickness) in order to provide a sufficient cross-sectional flow area, to dissipate heat, and to withstand mechanical stress.

Despite the obvious advantages of rotary as compared to reciprocating motion, especially at high speeds, poppet valves have found much greater acceptance heretofore than rotary valves. That is because rotary valves in the forms in which they have existed heretofore have had drawbacks even more serious than those of poppet valves.

A principal drawback of earlier rotary valves has been the sealing problem. A rotary valve comprises an outer metallic stationary support member formed with a hollow interior, and an inner metallic member housed within the hollow interior and mounted for rotation about an axis. The outer support member and inner rotatable member are formed with ports and ducts for selectively enabling and preventing the flow of intake and exhaust gases through the valve in accordance with the angular position of the inner rotatable member with respect to the outer support member. It is essential to prevent or minimize leakage of gas between the stationary and rotatable parts of the valve during the times when the valve is closed and ensure that all the flow is through the intended channel when the valve is open. To this end, and in view of unavoidable manufacturing tolerances between the metallic stationary and rotating parts of the valve, special seals are necessary. This is in contrast to poppet valves in which the valve head seats without appreciable sliding and special seals are unnecessary.

The seals of a rotary valve are subject to unfavorable conditions. Engine temperatures are high, and so is the pressure within the combustion chamber, especially during the power stroke, when the intake and exhaust ports are both closed and the pre-compressed fuel-air mixture is in the process of rapid combustion. The seals must contain this pressure in order to ensure that the available energy is transferred to the piston with maximum efficiency.

A problem of long standing with conventional internal combustion engines, regardless of the type of valve employed, has been uneven distribution of fuel in the fuel-air mixture from one point to another in the combustion chamber. A relatively small quantity of fuel is mixed, by a process involving aspiration or injection, with a much larger quantity of air. The fuel is introduced into the air at a specific location and must be dispersed or distributed uniformly throughout the volume of air if the nominal fuel-air ratio is to represent not just a statistical average but the actual ratio at each point in the combustion chamber. Various designs have been employed in an effort to realize this objective, but the objective remains elusive.

Another problem of long standing with conventional internal combustion engines, regardless of the type of valve employed, has been a limitation on the amount of air that can be inducted or injected, which in turn limits the amount of fuel that can be introduced in accordance with the prescribed fuel-air ratio and thus also limits the maximum power of the engine. The air-induction limitation depends on ambient air pressure and on engine design and speed. The current accepted solution to the problem is turbocharging—a process by which engine exhaust gas or another source of power drives an impeller in the air-intake system to force additional air into the engine. Turbocharging is used especially in high-performance cars and piston-engine aircraft. However, turbocharging adds considerably to the initial cost of the basic engine and to the cost of maintenance. For this reason, it has not found acceptance except in special situations where high performance is mandatory.

Moreover, rotary valve designs have in the past been inefficient because of their complicated design and excessively subject to bearing failure because of excessive temperatures and insufficient lubrication.

Examples of prior attempts to improve the design of rotary valves include those described in a patent to Lockshaw U.S. Pat. No. 4,016,840 and a patent to Guenther U.S. Pat. No. 4,036,184. Both patents relate to implementation of the stratified-charge principle. The latter patent discloses a rotary valve operating at one-quarter engine RPM and having a diametral connecting duct between the intake manifold and the combustion chamber. A separate and isolated diametral conducting duct is provided for the exhaust gases, and these ducts are remote from one another. U.S. Pat. No. 4,016,840 discloses a valve body that also operates at one-quarter engine RPM and a central exhaust conduit that precludes exhaust tuning. The valve body diameter must be large in order to accommodate a central exhaust conduit and a water jacket surrounding it and to provide adequate flow area for the intake ducts surrounding the water jacket. As a result, the valve is necessarily relatively heavy and expensive.

SUMMARY OF THE INVENTION

An object of the invention is to remedy the problems outlined above and in particular to provide a rotary valve having seals that perform satisfactorily at all engine speeds; that contributes to the attainment of a highly-uniform fuel-air mixture in the combustion chamber; that provides a supercharging effect; and that has greater efficiency and a longer mean service life than previously proposed rotary valve designs.

The foregoing and other objects are attained by the provision of a rotary valve for an internal combustion engine, comprising an outer stationary support member formed with a hollow interior, an inner valve member housed within the hollow interior, and bearing means supporting the valve member for rotation about an axis.

In one embodiment of the invention, the outer support member and the inner rotatable member are formed with (i) ducting means, (ii) porting means for selectively enabling and preventing the flow of intake and exhaust gas through the valve ducting means in accordance with the angular position of the inner rotatable member with respect to the outer support member and (iii) surfaces in closely-spaced-apart opposed relation to each other. Substantially annular sealing means is mounted between the opposed surfaces to prevent leakage of gas therebetween. In accordance with the invention, the portion of the opposed surfaces between which the annular sealing means is mounted is substantially parallel to a plane normal to the rotational axis. By virtue of this construction, the sealing ability of the annular sealing means is preserved despite any displacement of the annular sealing means due to combustion pressure or rotation of the rotatable member.

Either the rotatable member or the stationary support member may be formed with an annular groove within which the annular sealing means is mounted.

In accordance with another aspect of the invention, which particularly suits it for cooperation with a multi-cylinder internal combustion engine, the inner rotatable member is of stepped diameter and comprises (i) a plurality of first portions respectively cooperating with the engine cylinders and having a relatively large outside diameter and (ii) a plurality of second portions respectively cooperating with the first portions and having a relatively small outside diameter. Strip sealing means for isolating the respective cylinders during the compression and power strokes is mounted between the opposed surfaces of the outer support member and the inner rotatable valve member. The strip sealing means comprises a plurality of strip seals each extending in an axial direction with respect to the inner rotatable member in a substantially straight line. These strip seals respectively form seals between the inner rotatable member and the outer support member at each of the first portions of the inner rotatable member.

The strip seals may be mounted in grooves formed in either the rotatable member or the stationary support member.

In accordance with another aspect of the invention wherein a rotary valve comprises an outer stationary support member, an inner member housed therein, and bearing means supporting the inner member for rotation about an axis, the outer support member and the inner rotatable member being formed with duct and port means as defined above, a portion of the duct means formed in the outer support member serves also as a portion of the combustion chamber.

The portion of the duct means serving also as a portion of the combustion chamber has a cross-sectional area that is small as compared to the cross-sectional area of the engine cylinder. The ratio of the smaller area to the larger area is preferably within the range of 1:2 to 1:4, and the boundary between the smaller area and the larger area is delimited by an abrupt step. This produces a "squish" effect that increases turbulence and improves mixing, thereby providing a more uniform fuel-air ratio from point to point in the combustion chamber.

In accordance with another aspect of the invention, impeller means is mounted within the portion of the duct means formed within the inner rotatable member for producing a mixing and supercharging effect upon rotation of the inner rotatable member.

The impeller means preferably comprises a plurality of blades mounted in planes extending radially with respect to the axis of rotation or fanning out from the axis of rotation and curving outwardly and rearwardly with respect to the direction of rotation.

In one embodiment of the invention, the duct means forms one or more side ports in the inner rotatable member through which gas flow is in a direction substantially parallel to the axis of rotation.

In an embodiment of the rotary valve particularly suited for a multi-cylinder internal combustion engine, the outer support member and the inner rotatable member define separate duct means for each cylinder, the bearing means comprises a bearing at each end of the inner rotatable member, relatively distant from the engine cylinders, and the valve further comprises collection and distribution pieces forming parts of the duct means and mounted in planes that lie between engine cylinders. This effectively removes the valve bearings from the hottest parts of the engine and facilitates better lubrication than that attainable in previously proposed rotary valve designs.

The collection and distribution pieces are preferably formed separately from the outer stationary support member and the inner rotatable member and remain stationary during rotation of the inner rotatable member.

The outer stationary support member preferably also serves as a cylinder head for the engine.

Finally, in one preferred embodiment of the invention, the intake duct means associated with each cylinder is substantially straight, and the valve rotates at an angular speed equal to one-quarter rather than one-half the angular speed of the crankshaft. The fuel-air mixture during two successive intake strokes relating to a given cylinder flows through the same intake duct means, the direction of flow being the same with respect to the support member but reversed with respect to the valve member from one intake stroke to the next. In this embodiment of the invention, the exhaust duct means preferably substantially surrounds the intake duct means, whereby the fuel-air intake mixture is warmed by heat from the exhaust gases.

BRIEF DESCRIPTION OF THE DRAWINGS

A better understanding of the invention may be gained from a consideration of the following detailed description of the preferred embodiments thereof, taken in conjunction with the appended figures of the drawing, wherein.

DESCRIPTION OF THE PREFERRED EMBODIMENTS

Figure 1:
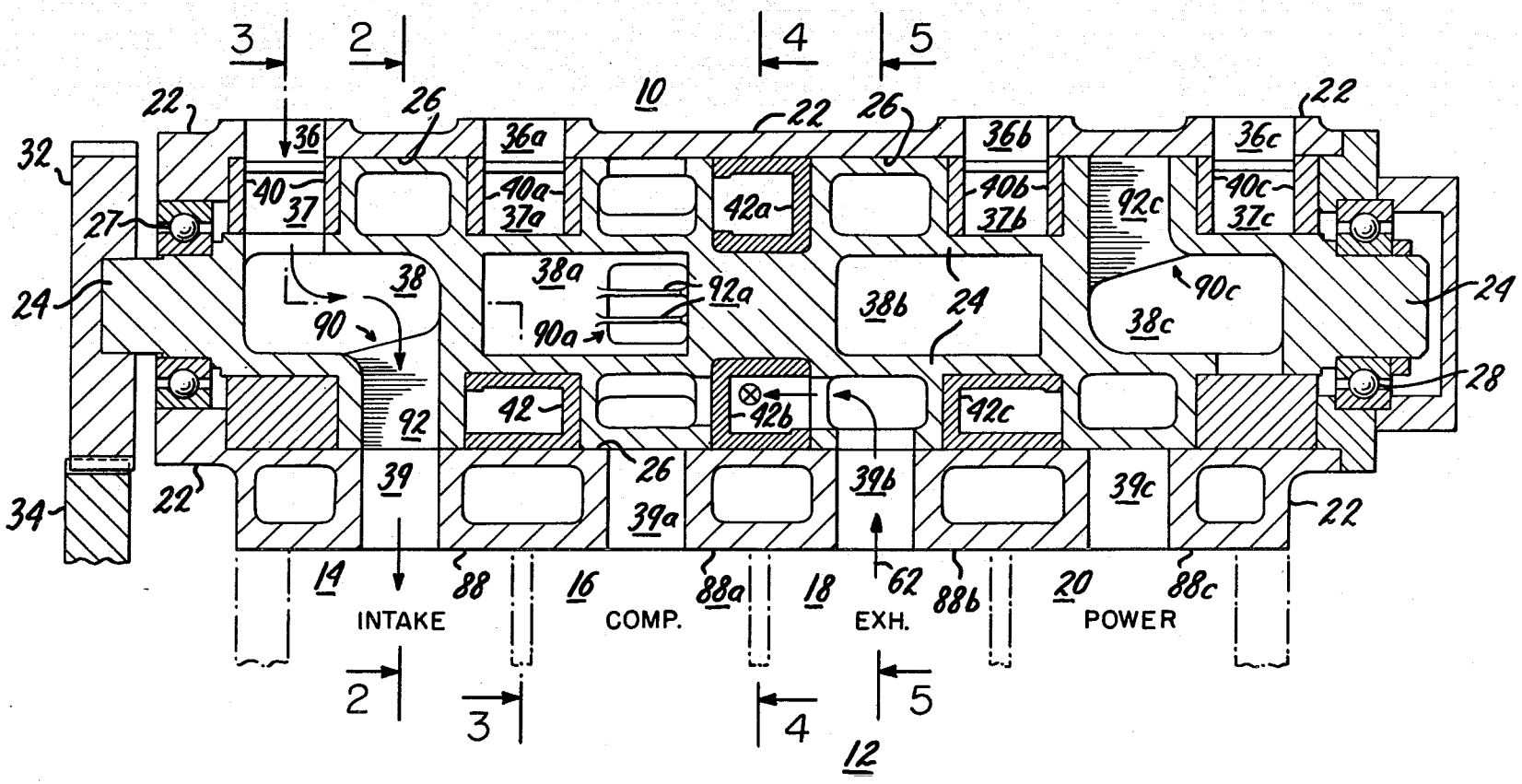
FIG. 1 is a longitudinal or axial view in section of a preferred embodiment of a rotary valve constructed in accordance with the invention.

FIG. 1 shows a rotary valve 10 constructed in accordance with the invention and cooperating with an internal combustion engine 12 that is shown in diagrammatic, fragmentary outline in FIG. 1 by phantom lines. The valve 10 cooperates with four in-line cylinders 14, 16, 18 and 20, respectively. If the engine is, for example, of V-8 design, then another valve cooperating with another bank of cylinders like the one shown would also be provided.

The cylinder 14 is shown during the intake stroke, the cylinder 16 during the compression stroke, the cylinder 18 during the exhaust stroke, and the cylinder 20 during the power stroke. The valve 10 comprises an outer stationary support member 22, which preferably also serves as the cylinder head of the engine 12, and an inner valve member 24 of stepped-diameter, one-piece construction housed within the hollow interior 26 of the support member or cylinder head 22. The valve 10 comprises individual valve bodies for each cylinder connected to one another by hollow or solid cylinders.

Figure 2:
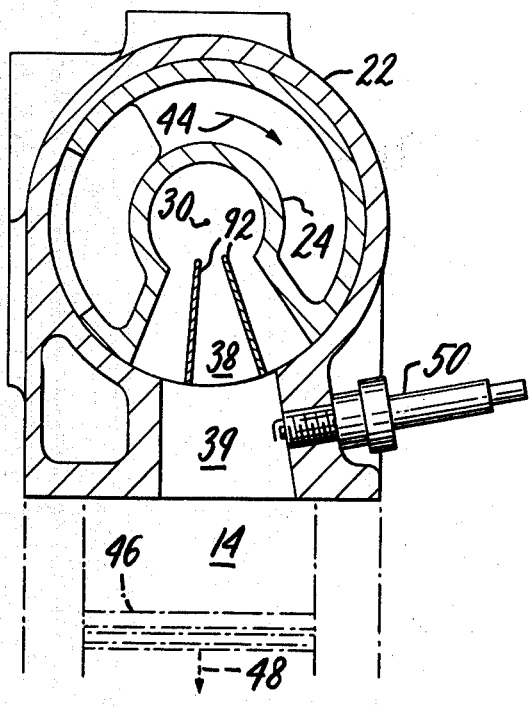
FIGS. 2–5 are sectional views, perpendicular to the axis of rotation, taken along the section lines 2—2, 3—3, 4—4, and 5—5, respectively, in FIG. 1, and looking in the directions of the arrows respectively associated with the section lines in FIG. 1.
Figure 3:
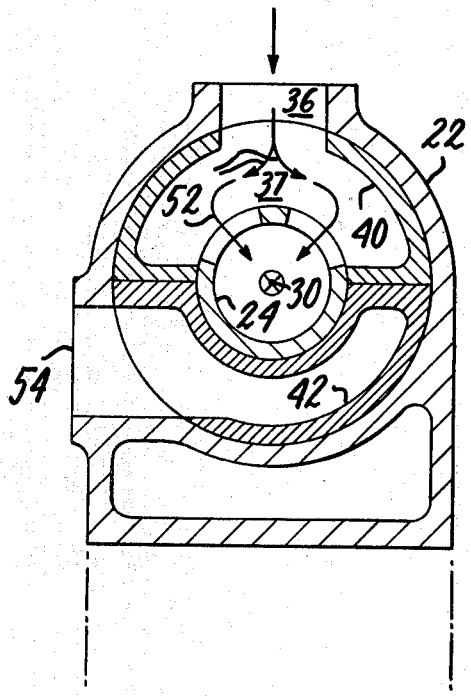

Bearing means comprising bearings 27, 28 support the valve member 24 for rotation about an axis 30 concentric with the valve member 24, as FIGS. 2 and 3, for example, show.

A gear 32 meshes with another gear 34 in a gear train driven by the engine 12, whereby the valve member 24 is caused to rotate at a speed that is synchronized with engine speed (and equal to one-half the engine RPM) and to assume at all times a prescribed angle in relation to the crankshaft angle of the engine 12. A chain or timing belt drive can also be utilized for this purpose.

The outer stationary support member or cylinder head 22 and the inner rotatable valve member 24 are formed with duct means exemplified by the intake passage 36, 37, 38, 39 in FIG. 1.

A rotary valve embodying the principles of the present invention is adapted for use with a spark-ignition or compression-ignition engine and with a two-cycle or four-cycle engine. For purposes of concrete explanation, the engine 12 is represented as a spark-ignition internal combustion engine having four strokes per cycle. As noted above, these strokes are represented at the bottom of FIG. 1 as intake, compression, exhaust, and power for the cylinders 14, 16, 18 and 20, respectively. At the end of one complete engine cycle consisting of these four strokes, the valve 10 will have turned through 360°, and the next cycle will commence.

In principle the valve 10 could be divided into four sections spaced along its axis, each section being identical to the others and the sections being angularly spaced relative to one another at 90-degree intervals in accordance with cylinder firing order. In practice, the valve 10 can be made more compact and at the same time better lubrication and cooling can be achieved if the several sections are not quite identical.

Thus intake passages or duct portions 36*a*, 36*b*, and 36*c* are identical to the intake passage or duct portion 36; duct portions 37*a*, 37*b* and 37*c* are identical to the duct portion 37; and duct portions 39*a*, 39*b* and 39*c* are identical to the duct portion 39. Moreover, the duct portions 38*a*, 38*b* and 38*c* are generally similar to the duct portion 38. However, distributor pieces 40, 40*a*, 40*b* and 40*c* are mounted axially displaced from the center lines of the cylinders 14, 16, 18 and 20 to which they respectively relate in directions toward the nearer of the bearings 27, 28. These distributor pieces are shown in perspective in FIG. 6. The intake duct upper portions 36, 37 for the cylinder 14 and the corresponding intake duct upper portions for the cylinders 16, 18 and 20 are likewise displaced axially along the valve from the cylinder center lines. Since the lower duct portions 39, 39*a*, 39*b* and 39*c* are coaxial with the cylinders 14, 16, 18 and 20, respectively, the duct portions 38, 38*a*, 38*b* and 38*c* form a bend in the intake configuration in order to define a continuous passage for the intake fuel-air mixture.

In the case of the left-hand cylinder 14, the flow of intake fuel-air mixture (as seen from the perspective of FIG. 1) is down, to the right, and then down again. Upon rotation of the valve member 24 through an angle of 270° from the position illustrated in FIG. 1, the second cylinder 16 will be in the intake configuration, and the flow of intake fuel-air mixture will be the same as in the case of the cylinder 14: i.e., down through duct portions 36*a* and 37*a*, to the right through duct portion 38*a*, and then down again through the duct portion 39*a*.

Upon rotation of the valve 10 through an angle of 90° with respect to its position shown in FIG. 1, the valve is in an intake configuration with respect to the cylinder 18. In this case, because the duct portions 36*b* and 37*b* are displaced in the opposite direction (i.e., to the right in FIG. 1) along the axis of the valve 10 from the center line of the associated cylinder 18, the intake fuel-air mixture moves down through the duct portions 36*b* and 37*b*, to the left through the duct portion 38*b*, and then down through the duct portion 39*b*.

Figure 6:
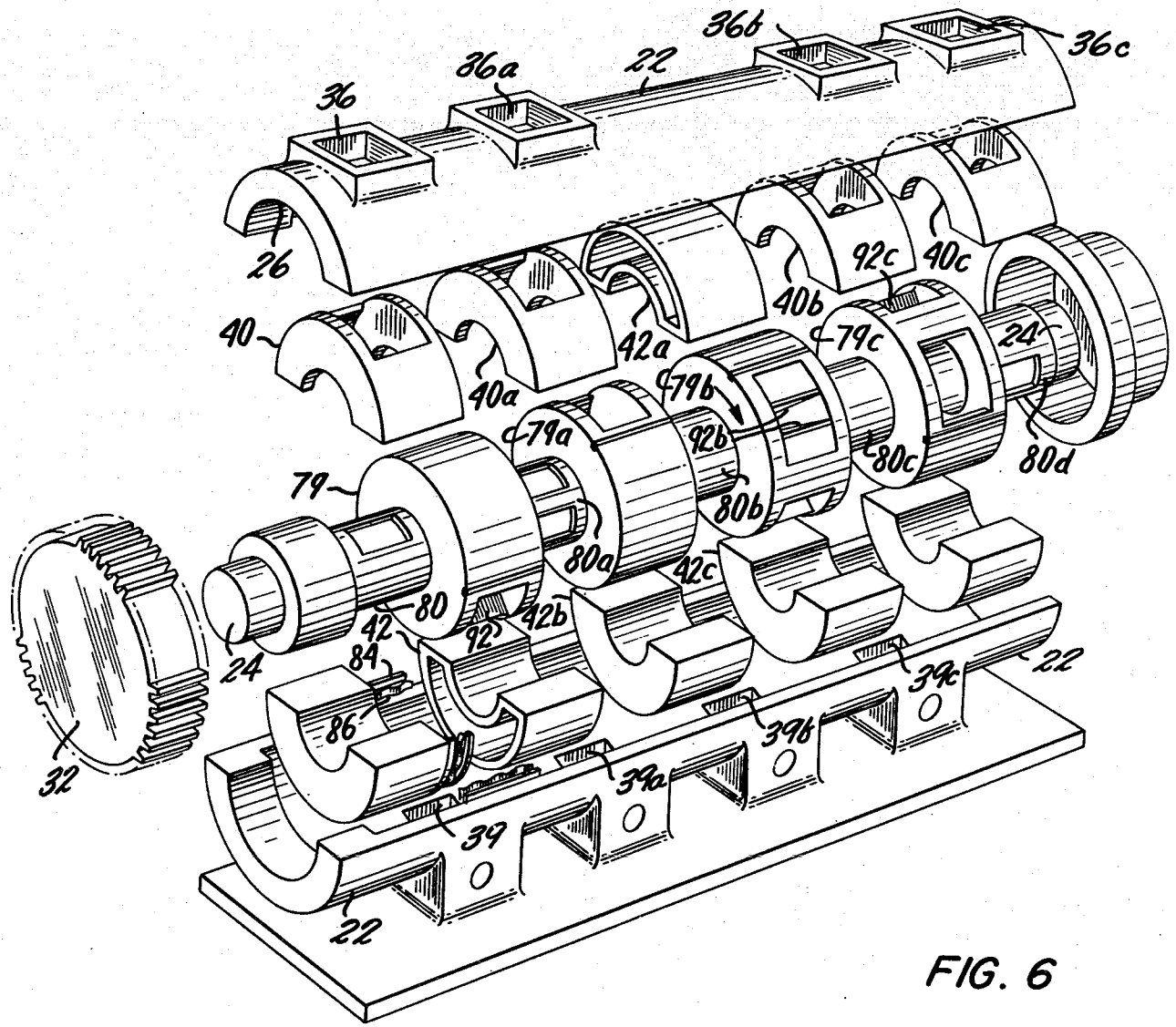
FIG. 6 is an exploded isometric perspective view of the valve of FIG. 1.

When the valve 10 is rotated through an angle of 180° from its position illustrated in FIGS. 1 and 6, the valve 10 is in an intake configuration with respect to the cylinder 20. In this case, the flow of intake fuel-air mixture is down through the duct portions 36*c*, 37*c*, to the left through the duct portion 38*c*, and then down again through the duct portion 39*c*.

FIGS. 1 and 6 illustrate the valve 10 as being in the exhaust configuration with respect to the cylinder 18. In this case, the exhaust gas flows up through the duct portion 39*b*, and then to the left into a collector piece 42*b* (see also FIG. 4).

Upon rotation of the valve 10 through an angle of 90° from the position illustrated in FIGS. 1 and 6, the valve 10 will be in the exhaust configuration with respect to the cylinder 20. In this case, the exhaust gas will flow up through duct portion 39*c* and then to the left through collector piece 42*c*.

When the valve 10 is rotated 270° from its position as illustrated in FIGS. 1 and 6, it will be in the exhaust configuration with respect to the cylinder 14. In this case, the flow of exhaust gas will be up through the duct portion 39 and then to the right through the collector piece 42 (see also FIG. 3).

When the valve 10 is rotated 180° with respect to its position as illustrated in FIGS. 1 and 6, it is in an exhaust configuration with respect to the cylinder 16. In this case, the flow of exhaust gas is upward through the duct portion 39*a*, across duct portion 38*a* to the opposite side of the valve, and out through collector piece 42*a* (see also FIG. 4).

The duration of the port openings that accommodate the intake and exhaust strokes is determined by the circumferential length of the respective cooperating ports. During both the compression and power strokes, which are separated by an angle of 90°, a solid portion of the rotatable valve member 24 blocks the upper ends of duct portions 39, 39*a*, 39*b* and 39*c*, as illustrated in FIG. 1 in the case of duct portions 39*a* and 39*c*.

FIG. 2, which is a section through the line 2—2 of FIG. 1, shows by an arrow 44 the direction of rotation of the valve member 24. It also shows the outer stationary support member or cylinder head 22, the duct portions 38 and 39 leading to the cylinder 14, a piston 46 moving downwardly on its intake stroke as indicated by an arrow 48, and a spark plug 50 for igniting the fuel-air mixture at the proper instant.

FIG. 3, which is a sectional view along the broken line 3—3 of FIG. 1, shows the distributor piece 40 and the collector piece 42 for the cylinder 14, the outer stationary support member or cylinder head 22, and the rotatable inner valve member 24. The X passing through the axis 30 represents an arrow tail and indicates that the flow of air at that point is axially into the plane of the drawing (i.e., to the right of FIG. 1). The flow through the duct portions 36 and 37 is generally downward, as indicated by arrows 52. The collector piece 42 communicates at its outlet 54 (visible in FIG. 3 but not in FIGS. 1 and 6) directly or indirectly with an exhaust manifold (not shown). The other collector pieces 42*a*, 42*b* and 42*c* communicate with the same manifold.

Figure 4:
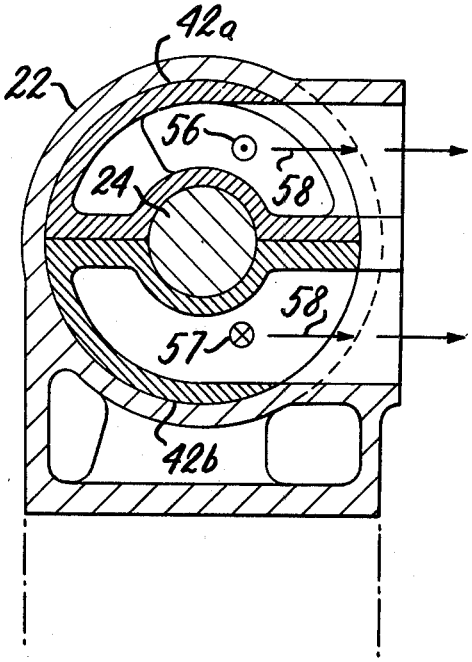

FIG. 4, which is a sectional view along the line 4—4, of FIG. 1, shows the outer stationary support member or cylinder head 22, the rotatable inner valve member 24, the upper collector piece 42*a* for the cylinder 16 and the lower collector piece 42*b* for the cylinder 18. The arrow nose 56 indicates that the direction of flow of the exhaust gas at the top of FIG. 4 is out of the plane of the drawing, and the arrow tail 57 indicates that the direction of flow of the exhaust gas at the bottom of FIG. 4 is into the plane of the drawing. Arrows 58 indicate that the exhaust gases from both of the cylinders 16 and 18 exit from the collectors 42*a*, 42*b* at the right as seen in FIG. 4 (at the rear as seen in FIGS. 1 and 6) and flow into the exhaust manifold (not shown).

Figure 5:
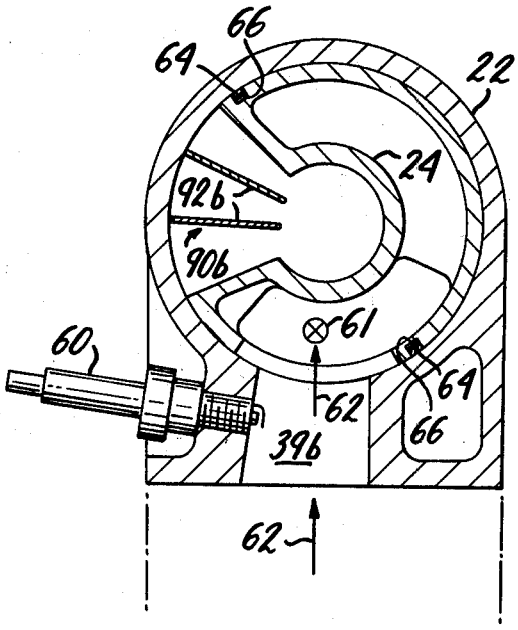

FIG. 5, which is a sectional view along the line 5—5 of FIG. 1, shows the outer stationary support member or cylinder head 22, the inner rotatable valve member 24, the duct portion 39*b*, and spark plug 60 for the cylinder 18. The arrow tail 61 indicates that the direction of flow of gas during the exhaust stroke is into the plane of FIG. 5 towards the collector piece 42*b* shown in FIGS. 1 and 4. Arrows 62 (FIGS. 1 and 5) indicate the direction of flow of exhaust gases through the duct portion 39*b* during the exhuast stroke. FIG. 5 also shows axial or longitudinal strip seals 64 mounted in grooves 66 formed in the inner rotatable valve member 24. These seals are discussed in greater detail below.

Side face sealing can be accomplished by installing the seals in grooves formed either in the rotating valve member or in the outer stationary support member.

A single-cylinder engine having only one enlarged portion of the rotating valve member permits free access to both side faces of the enlarged portion and this permits the employment of split or unsplit side face seals.

Multiple cylinder engines do not provide this access and, therefore, full circumferential seals must be split into at least two segments. An alternate design employs half circumferential seals installed into grooves in the lower half of the stationary split housing as indicated in FIG. 6.

Regardless of which configuration is employed the sealing principle is the same. Contact between the seal face and the opposing seal surface is achieved by a wavy spring located behind the seal face. During the compression and power strokes the pressure of the gases enhances this initial sealing pressure. This gas pressure against the outer diameter surface of the seal also forces the seal radially inward so that its inner diameter surface establishes close contact with the groove outer diameter surface providing an obstacle to the leakage of gases.

Figure 7:
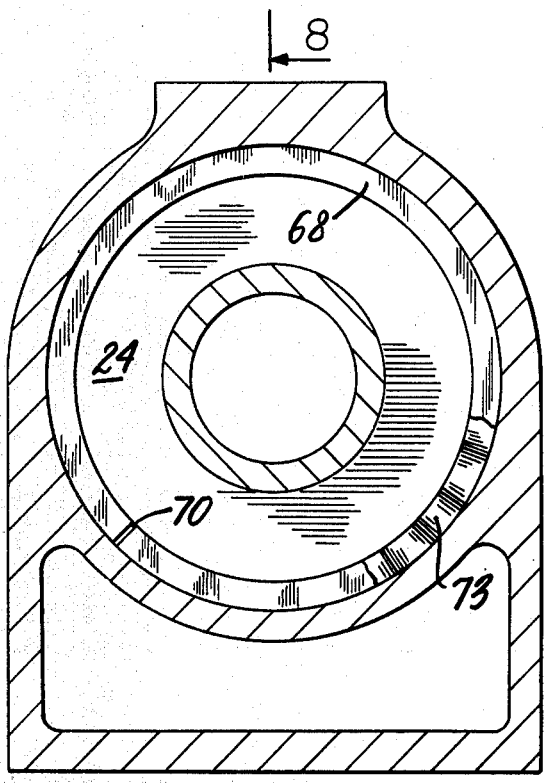
FIG. 7 is an axial view taken along the section line 7—7 of FIG. 8, looking in the direction of the arrows, and showing details of a first form of annular sealing means employed in accordance with the invention.
Figure 8:
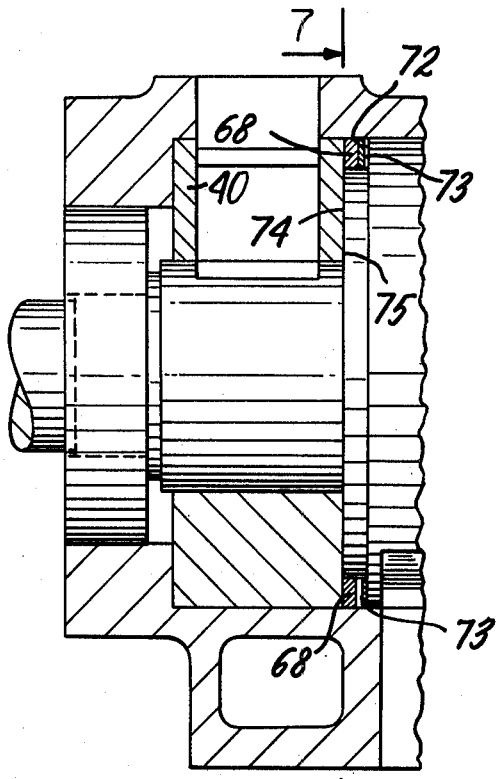
FIG. 8 is a longitudinal view, partly in section, taken along the line 8—8 of FIG. 7 and looking in the direction of the arrows.

FIGS. 6–10 show side-face sealing means in accordance with the invention (for clarity of the drawing, FIG. 6 omits the water jackets and many of the seals that would be employed in a practical case). The stepped diameter of the member 24, discussed in greater detail below, makes these seals possible. FIG. 7 shows a one-piece ring seal 68 typically made of cast iron, and mounted in groove 72 (FIG. 8) formed in a side face of the inner rotatable valve member 24. The seal 68 is forced to the left (FIG. 8) by a ring-shaped wavy spring 73. The opposed surfaces 74 (of the rotatable inner valve member 24) and 75 (of the outer stationary support member, which may comprise auxiliary stationary pieces such as the distributor piece 40, as noted above) are substantially parallel to a plane normal to the rotational axis of the inner rotatable valve member 24. The clearance between the seal inner diameter and the groove outer diameter is just sufficient to permit axial movement of the seal during operation. The clearance between the seal outer diameter and the stationary housing inner diameter is such that contact between these surfaces is prevented and full gas pressure against the seal outer diameter is permitted. This allows the gas pressure during compression and combustion to force the seal in radial and axial directions to seal against gas leakage.

Figure 9:
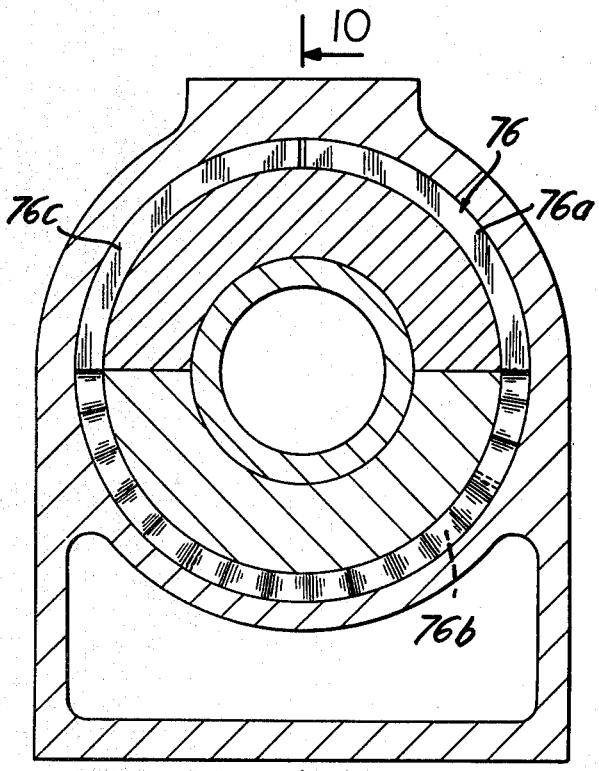
FIG. 9 is an axial view taken along the line 9—9 of FIG. 10, looking in the direction of the arrows, and showing details of another form of annular sealing means constructed in accordance with the invention.
Figure 10:
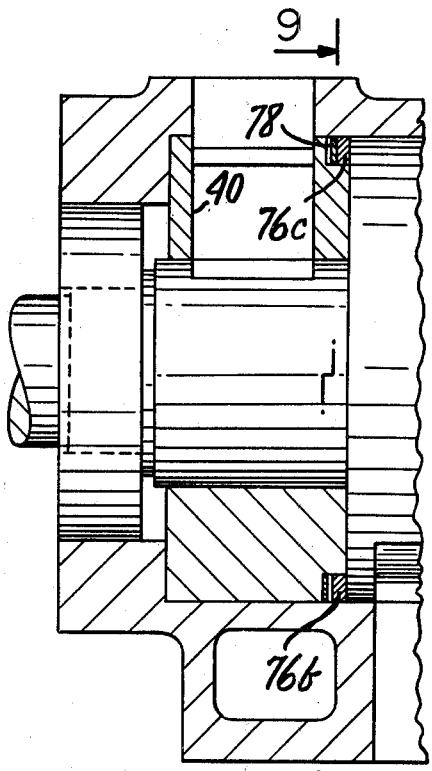
FIG. 10 is an axial view, partly in section, taken along the line 10—10 of FIG. 9 and looking in the direction of the arrows.

FIGS. 9 and 10 show a modification of the side-face sealing means comprising a seal 76 formed in three portions 76*a*, 76*b* and 76*c*. As FIG. 10 shows, the seal 76 may be mounted in a groove 78 formed in the outer stationary support member (which, as indicated above, may comprise a number of auxiliary pieces such as the distributor piece 40 held stationary with respect to the cylinder head). Means such as slots or scallops are provided in the outer diameter of the seal to insure that gas pressure can act on the outer diameter of the seal and against the surface opposite the sealing surface to provide increased seal effectiveness.

In accordance with another aspect of the invention, the inner rotatable member 24 is of stepped diameter, as FIG. 6 best shows, and comprises (i) a plurality of first portions 79, 79*a*, 79*b*, 79*c* respectively cooperating with the engine cylinders 14, 16, 18, 20 (FIG. 1) and having a relatively large outside diameter and (ii) a plurality of second portions 80, 80*a*, 80*b*, 80*c*, 80*d* cooperating with the first portions 79, 79*a*, 79*b*, 79*c* and having a relatively small outside diameter. Strip sealing means comprising a plurality of strip seals extending in an axial direction with respect to the inner rotatable member in a substantially straight line is mounted between opposed surfaces of the outer support member 22 and the inner rotatable member 24 to prevent leakage of gas therebetween and to isolate the respective cylinders during the compression and power strokes. These strip seals respectively form seals between the inner rotatable member 24 and outer support member 22 at each of the large-diameter first portions 79, 79*a*, 79*b*, 79*c*.

Figure 11:
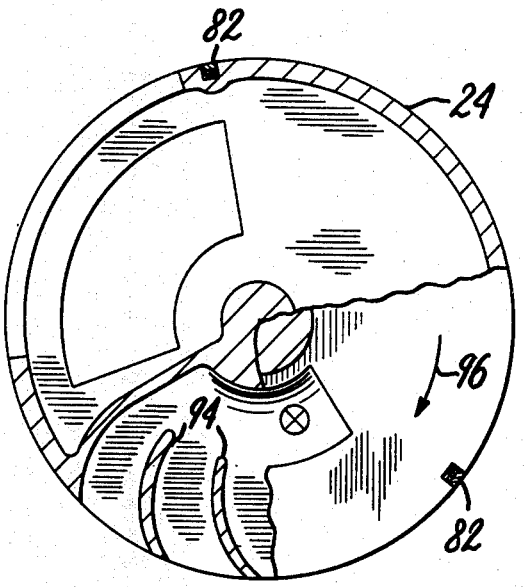
FIG. 11 is an axial cross-sectional view showing a rotary valve incorporating a preferred embodiment of an impeller and a strip sealing means in accordance with the invention.

The strip seals may be mounted in substantially straight grooves formed either in the large-diameter first portions 79, 79*a*, 79*b*, 79*c* or in the stationary support member. FIGS. 5 and 11 show strip seals 64 and 82 as examples of the former mounting, and FIG. 6 shows strip seals 84 as an example of the latter. In the case of both the strip and the annular seals, wavy springs back the seals to keep them in sealing relation to the surfaces to which they are opposed.

In accordance with another aspect of the invention, a portion of the duct means formed in the outer stationary support member 22 serves also as a portion of the combustion chamber. Specifically, the duct portions 39, 39*a*, 39*b* and 39*c* (FIG. 1) are respectively parts of the combustion chambers within the cylinders 14, 16, 18 and 20. As illustrated in FIG. 1 in connection with the cylinders 16 and 20 during the compression and power strokes, these duct portions are closed off from the remainder of the ducts of which they are respectively parts. As illustrated in FIGS. 2 and 5, the spark plugs 50 and 60 as well as the spark plugs (not shown) for the cylinders 16 and 20 are mounted in such a manner as to cause a spark in the respective duct portions 39, 39*a*, 39*b* and 39*c*.

The respective duct portions 39, 39*a*, 39*b* and 39*c* have cross-sectional areas that are small as compared to the cross-sectional area of the engine cylinders 14, 16, 18 and 20. Preferably, the ratio of the smaller area to the larger area is within the range of 1:2 to 1:4. Moreover, the boundary between the smaller cross-sectional area (of the duct portions 39, 39*a*, 39*b*, and 39*c*) and the larger cross-sectional area (of the cylinders 14, 16, 18 and 20) is delimited by an abrupt step as indicated by shoulders 88, 88*a*, 88*b* and 88*c*, respectively, in FIG. 1.

As a result of this structure, a "squish" effect is produced during the compression stroke, which causes great turbulence of the fuel-air mixture. As the piston rises in the engine cylinder during the compression stroke, a large volume of air is not only compressed, as in conventional internal combustion engines, but is also caused to flow in multiple directions by virtue of the abrupt step 88, 88*a*, 88*b* or 88*c*. This violent and abrupt routing and rerouting of the fuel-air mixture as it is being compressed causes a thorough mixing of the fuel with the air and a uniform distribution of the fuel from one point to another within the combustion chamber prior to ignition. This in turn ensures a more uniform and complete combustion earlier in the power stroke, a better transfer of energy to the piston, and increased power output.

Another aspect of the invention involves impeller means mounted within the portion of the duct means formed within the inner rotatable member 24 for producing a mixing and supercharging effect upon rotation of the inner rotatable member 24. FIG. 1 shows impeller means 90, 90*a* and 90*c* comprising, respectively, impeller blades 92, 92*a* and 92*c*. FIG. 2 shows two of the impeller blades 92 and FIG. 5 shows impeller means 90*b* comprising impeller blades 92*b* not visible in FIG. 1. Blades 92, 92*b* and 92*c* are visible in FIG. 6. The blades illustrated in FIGS. 1, 2, 5 and 6 are mounted in planes extending radially with respect to the axis of rotation of the inner valve member 24. The impellers in each valve chamber are formed by simple coring when the valve is cast or by insertion and subsequent welding of sheet steel elements into cored or machined slots.

Figure 12:
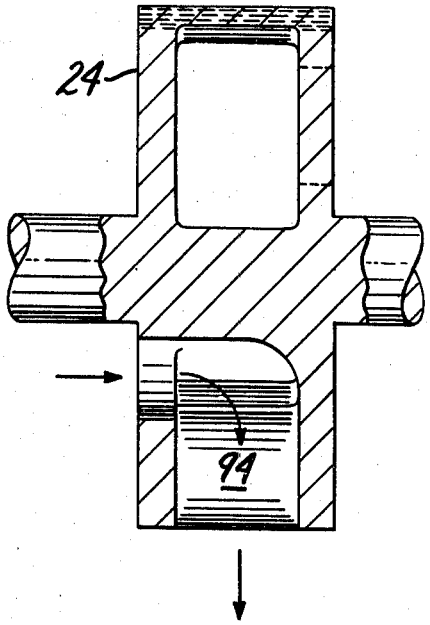
FIG. 12 is a fragmentary axial section of the structure of FIG. 11.

FIGS. 11 and 12 illustrate a preferred embodiment wherein the impeller means comprises a plurality of blades 94 fanning out from the axis of rotation of the inner valve member 24 and curving outwardly and rearwardly with respect to the direction of rotation, which is represented by an arrow 96.

In accordance with another aspect of the invention, particularly adapted for use in a multi-cylinder internal-combustion engine, the outer support member or cylinder head 22 and the inner rotatable member 24 define separate duct means for each cylinder (as already explained in connection, for example, with FIG. 1); the bearings 27 and 28 are at opposite ends of the inner rotatable member 24; and the valve further comprises split collector and distribution pieces 40, 40*a*, 40*b*, 40*c* and 42, 42*a*, 42*b* and 42*c*, as disclosed above, forming portions of the duct means and positioned in planes that lie between engine cylinders. The provision of individual valve chambers for each cylinder permits short flow paths for the intake mixture and exhaust gases. Volumetric efficiency, particularly at high engine speeds, is consequently substantially higher than in other rotary-valve designs. For applications in which low pollutants at low engine speeds is the goal, this design permits less valve overlap with minimum sacrifice in intake mixture and exhaust gas flow restriction and consequently less power loss. The individual chambers permit exhaust gas to exit efficiently from the engine, thereby reducing distortion and mitigating lubrication problems. These individual chambers also permit the stepped-diameter design described elsewhere herein which in turn enables utilization of the side-seal technology already developed for Wankel engines to seal cylinders from one another during the compression and power strokes.

The collector and distribution pieces 40, 40*a*, 40*b*, 40*c* and 42, 42*a*, 42*b*, 42*c* are formed separately from the outer stationary support member or cylinder head 22 and the inner rotatable member 24 and remain stationary during rotation of the inner rotatable member 24. The arrangement of collector and distributor pieces in planes between engine cylinders permits the support bearings 27, 28 to be located remotely from the high-temperature areas of the head. Bearing lubrication can therefore be accomplished by conventional means.

Many prior designs use water jacketing or insulating air space surrounding the exhaust chamber to keep the bearing temperature at an acceptable level when the exhaust chamber surrounds the outer chamber and this increases the size and complexity of the rotating valve. Designs locating the exhaust chamber concentric with and surrounded by the intake chamber preclude the use of impellers to introduce the fuel-air mixture into the cylinder without an inordinate increase in the diameter of the rotating member.

Moreover, the split design facilitates manufacture and assembly of the valve and cylinder head. The loose pieces can be selected to match individual valve assemblies, eliminating the more difficult close-tolerance machining required if a stepped-diameter valve were used in conjunction with a stepped-diameter head casting.

Figure 13:
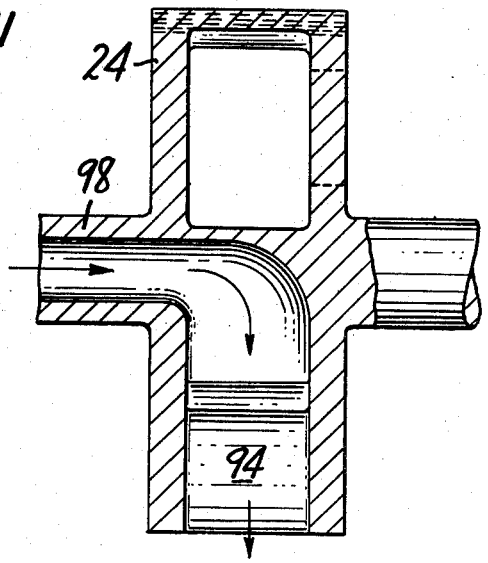
FIG. 13 is a view similar to FIG. 12 but showing another embodiment of the invention.

In any reciprocating internal combustion engine where there are not more than two cylinders mounted together, for example, in a single-cylinder or two-cylinder engine, a radial engine, or a four-cylinder engine with two cylinders mounted in opposed relation to the other two, it is possible to introduce the fuel-air mixture through a hollow shaft 98 (FIG. 13) integral and concentric with the inner rotatable valve member 24. This is especially advantageous in the case of fuel injection.

Figure 14:
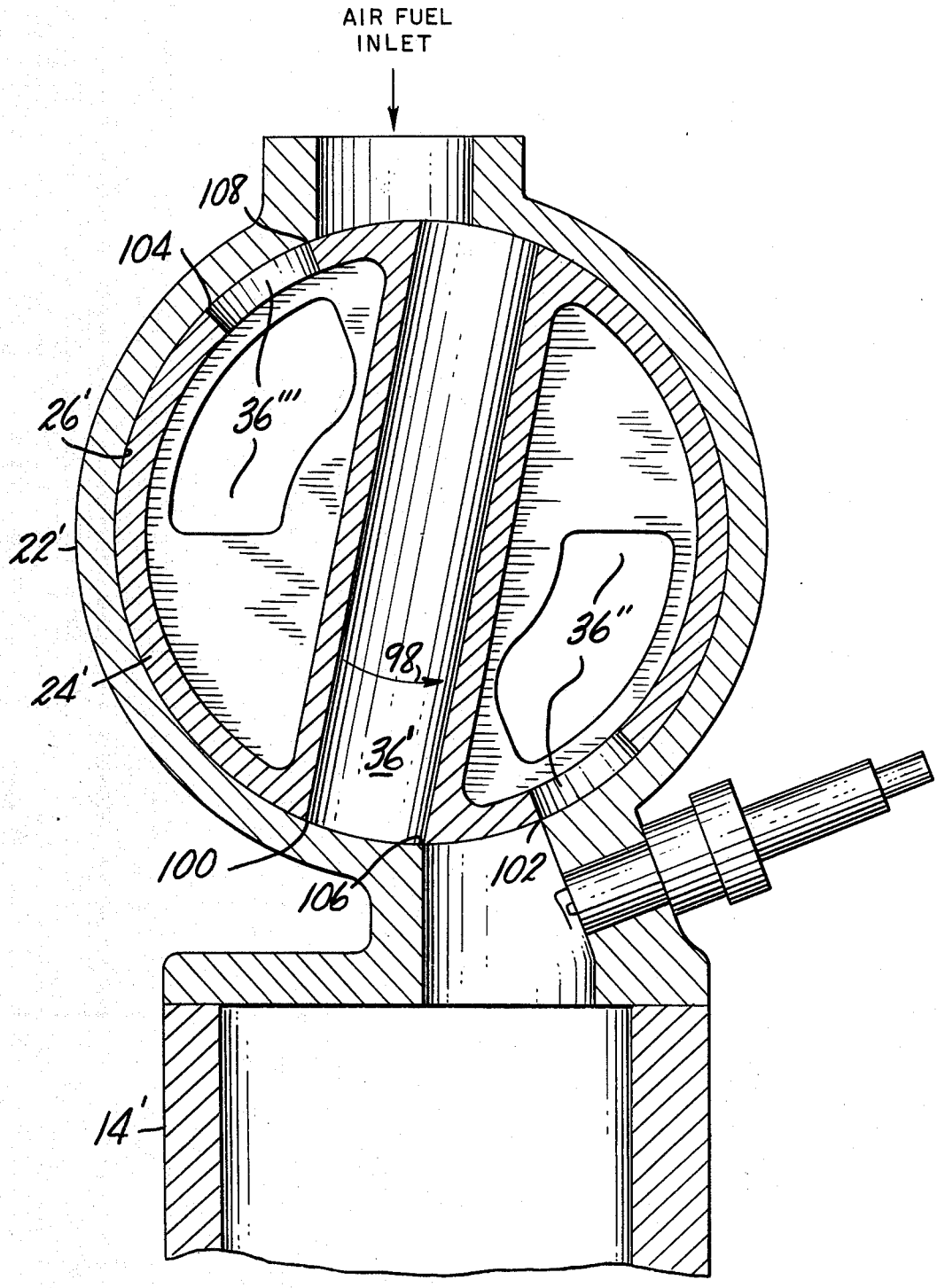
FIG. 14 is a sectional view, perpendicular to the axis of rotation, of an embodiment of the invention wherein the valve member rotates at an angular rate equal to one-quarter that of the crankshaft, and wherein the intake ducting is straight and substantially surrounded by exhaust ducting.

FIG. 14 discloses an embodiment of the invention that is especially adapted for use in a multi-cylinder engine and that rotates at an angular rate equal to one-quarter rather than one-half that of the crankshaft. The valve is shown as cooperating with a cylinder 14' in which there are the usual successive intake, compression, power and exhaust strokes. It comprises an outer stationary support member 22' formed with a hollow interior 26' and an inner rotatable valve member 24' housed within the hollow interior 26'. The outer support member 22' and the inner rotatable member 24' are formed with intake duct means 36' for the passage of a fuel-air intake mixture and exhaust duct means 36'' and 36''' for the passage of exhaust gases. Porting means defined by the cooperation between the outer stationary support member 22' and the inner valve member 24' selectively enables and prevents the flow of intake and exhaust gases through the duct means 36', 36'', and 36''' to and from the cylinder 14' in accordance with the angular position of the inner rotatable member 24' with respect to the outer support member 22'.

In accordance with the invention as embodied in the structure of FIG. 14, the intake duct means 36' is substantially straight and diametral with respect to the valve member 24', and means such as a gear train, a timing belt or a timing chain is provided for rotating the valve member 24' at an angular speed equal to one-quarter the angular speed of the crankshaft. As a result, the fuel-air mixture in the valve member 24' during two successive intake strokes relating to the cylinder 14' flows through the same intake duct means 36', the direction of flow being the same (i.e. vertically downward in FIG. 14) with respect to the support member 22' but reversed with respect to the valve member 24' from one intake stroke to the next.

FIG. 14 shows the valve as the exhaust stroke has just been completed and as the intake stroke is just about to commence: i.e., the piston is at the top of its stroke (in a practical case, a slight valve overlap is provided by enlarging the intake and exhaust ports slightly as compared to the exact theoretical relationship shown in FIG. 14).

An arrow 98 shows the direction of rotation of the valve member 24'. As the piston descends and the valve member 24' turns counterclockwise from the position illustrated in FIG. 14, the fuel-air mixture is drawn vertically downward through the intake passage 36'. When the edge 100 of the valve member 24' meets the edge 102 of the outer stationary support member 22', the piston is at the bottom of its stroke and the intake of fuel-air mixture is terminated. As the valve member 24' continues to rotate, the piston moves up during the compression stroke and then down during the power stroke. The porting means during these two strokes closes off the valve from the cylinder.

At the end of the power stroke, the edge 104 of the valve member 24' coincides with the edge 106 of the outer stationary support member, and the exhaust gas beings to flow through the exhaust duct 36''' as the piston begins to rise in the cylinder 14'.

When the edge 108 of the valve member 24' meets the edge 102 of the outer stationary support member 22', the exhaust stroke has been completed, the piston is once again at the top of its stroke, and the next intake stroke is ready to commence. At this time also, the valve member 24' presents exactly the same appearance as in FIG. 14, even though the valve member 24' has turned through only 180° rather than a full 360°. The reason for the identical appearance is that the valve member 24' is symmetrical about the center line of the diametral intake duct 36'. Because of this symmetry, the process just described is repeated, but in this case the flow of exhaust gases is through the duct 36'' rather than 36''', and the flow of fuel-air mixture through the duct 36' while in the same direction as before with respect to the outer stationary support member 22' (and the entire engine for that matter), is reversed with respect to the valve member 24', in view of the rotation of the latter through an angle of only 180°.

Preferably, the exhaust duct means 36'', 36''' substantially surrounds the intake duct means 36', as shown in FIG. 14. The advantage of this is that the fuel-air intake mixture is warmed by heat from the exhaust gas, so that improved fuel vaporization is achieved.

The embodiment of FIG. 14 is very efficient because of the straight path of the passage of the intake mixture, which results in less flow resistance and hence a greater capacity to supply fuel to the engine. This permits the development of equal power by an engine that is somewhat smaller, lighter and less expensive than would otherwise be required.

The embodiment of FIG. 14 has a number of clear advantages as compared to the structures disclosed in the patents cited above. In accordance with the present invention, additional power output is achieved by realization of the inherent potential provided by a rotating valve. Rather than implementing the stratified-charge principle, the present invention achieves the same results by improved fuel vaporization, improved mixture flow into the engine due to a short flow path, and the use of a single port leading to improved combustion chamber design, whereby flame travel can be shortened and crevices and dead spots can be minimized.

Thus there is provided in accordance with the invention a novel and highly-effective rotary valve for internal combustion engines that avoids the drawbacks of rotary valves that have prevented their commercial acceptance and that incorporates features ensuring reliable and efficient operation. Higher specific output is obtained from a reciprocating internal combustion engine than is possible with either conventional poppet-valve designs (including four-valves-per-cylinder racing designs) or conventional rotary-valve designs. The invention makes it possible to reduce pollutants resulting from high combustion chamber surface-to-volume ratios and from the discharge of unburned or partially-burned fuel-air mixture into the atmosphere when an engine is operated at low speeds. This can be achieved with less sacrifice in engine speed and power than in conventional poppet- or rotary-valve engines with large-surface-area combustion chambers and small port openings.

Many modifications of the preferred embodiments of the invention disclosed above will readily occur to those skilled in the art upon consideration of this disclosure. Accordingly, the invention is not limited to the specific details set forth above but extends to all of the structure that is within the scope of the appended claims, and to equivalents thereof.

I claim:

1. In a rotary valve for supplying a fuel-air mixture to and exhausting exhaust gas from an internal combustion engine, comprising (a) an outer stationary support member formed with a hollow interior, (b) an inner member housed within the hollow interior, and (c) bearing means supporting the inner member for rotation about an axis, the outer support member and the inner rotatable member being formed with duct means and porting means for selectively enabling and preventing the flow of intake and exhaust gases through the valve duct means in accordance with the angular position of the inner rotatable member with respect to the outer support member, the improvement comprising impeller means mounted within the portion of the duct means formed within the inner rotatable member, the impeller means moving in close proximity to an engine cylinder location at the porting means for providing the flow of intake gases to the cylinder, the impeller means comprising means for producing a mixing and supercharging effect in said intake gases introduced through the porting means to the cylinder upon rotation of the inner rotatable member, the impeller means comprising a plurality of blades mounted in planes extending radially with respect to the axis of rotation.

2. In a rotary valve for supplying a fuel-air mixture to and exhausting exhaust gas from an internal combustion engine, comprising (a) an outer stationary support member formed with a hollow interior, (b) an inner member housed within the hollow interior, and (c) bearing means supporting the inner member for rotation about an axis, the outer support member and the inner rotatable member being formed with duct means and porting means for selectively enabling and preventing the flow of intake and exhaust gases through the valve duct means in accordance with the angular position of the inner rotatable member with respect to the outer support member, the improvement comprising impeller means mounted within the portion of the duct means formed within the inner rotatable member, the impeller means moving in close proximity to an engine cylinder location at the porting means for providing the flow of intake gases to the cylinder, the impeller means comprising means for producing a mixing and supercharging effect in said intake gases introduced through the porting means to the cylinder upon rotation of the inner rotatable member, the impeller means comprising a plurality of blades fanning out from the axis of rotation and curving outwardly and rearwardly with respect to the direction of rotation.

3. In a rotary valve for supplying a fuel-air mixture to and exhausting exhaust gas from an internal combustion engine, comprising (a) an outer stationary support member formed with a hollow interior, (b) an inner member housed within the hollow interior, and (c) bearing means supporting the inner member for rotation about an axis, the outer support member and the inner rotatable member being formed with duct means and porting means for selectively enabling and preventing the flow of intake and exhaust gases through the valve duct means in accordance with the angular position of the inner rotatable member with respect to the outer support member, the improvement comprising impeller means mounted within the portion of the duct means formed within the inner rotatable member, the impeller means moving in close proximity to an engine cylinder location at the porting means for providing the flow of intake gases to the cylinder, the impeller means comprising means for producing a mixing and supercharging effect in said intake gases introduced through the porting means to the cylinder upon rotation of the inner rotatable member the impeller means including blades in longitudinal registration with an opening from within the inner rotatable member and located proximate the opening from within the inner rotatable member to impart a centrifugal force to the air-fuel mixture opening.

4. The valve according to claim 3 the duct means forming a side port in the inner rotatable member through which gas flow is in a direction substantially parallel to the axis of rotation.

5. The valve according to claim 3 wherein the inner rotatable member has a diameter at the impeller means at least substantially as large as the diameter of the engine cylinder and is adapted for rotation at one half engine speed of a four stroke internal combustion engine by having only a single opening for charging the cylinder with air-fuel mixture and a single opening for removal of exhaust gases at each cylinder location along its length, whereby the velocity of said blades and diameter at the impeller means contributes forcing of air-fuel mixture to the cylinders.

6. In a rotary valve for a multi-cylinder internal-combustion engine, comprising (a) an outer stationary support member formed with a hollow interior, (b) an inner valve member housed within the hollow interior, and (c) bearing means supporting the valve member for rotation about an axis, the outer support member and the inner rotatable member being formed with duct means and porting means for selectively enabling and preventing the flow of intake and exhaust gases through the valve duct means in accordance with the angular position of the inner rotatable member with respect to the outer support member, the improvement wherein the outer support member and the inner rotatable member define separate duct means for each cylinder, wherein the bearing means comprises a bearing at each end of the inner rotatable member, relatively distant from the engine cylinders, and wherein the valve further comprises split collector and distribution pieces forming portions of the duct means and positioned in planes that lie between engine cylinders.

7. A valve according to claim 6 wherein the collector and distribution pieces are formed separately from the outer stationary support member and the inner rotatable member and remain stationary during rotation of the inner rotatable member.

8. A valve according to claim 6 wherein the outer stationary support member also serves as the cylinder head for the engine.

9. In a rotary valve for supplying a fuel-air mixture to and exhausting exhaust gas from an internal combustion engine, comprising (a) an outer stationary support member formed with a hollow interior, (b) an inner member housed within the hollow interior, and (c) bearing means supporting the inner member for rotation about an axis, the outer support member and the inner rotatable member being formed with duct means and porting means for selectively enabling and preventing the flow of intake and exhaust gases through the valve duct means in accordance with the angular position of the inner rotatable member with respect to the outer support member, the improvement coomprising said inner rotatable member having sections of larger diameter aligned with engine cylinder locations and sections of smaller diameter between engine cylinder locations, side walls on the enlarged diameter sections extending inwardly to the smaller diameter sections, a port through at least one side wall of each enlarged diameter section, the duct means including a passage aligned with the smaller diameter sections and external of the rotatable member, said passage communicating with an opening out of the valve means, said outer member having a further opening at each cylinder location for communication with the cylinder, the enlarged diameter section having at least one opening in fluid communication with the side wall port and registering with the further opening in the outer member once each rotation of the inner rotatable member to place the cylinder location in fluid communication with the opening out of the valve means.

10. The valve according to claim 9 wherein the inner valve member sections of enlarged diameter terminate in side faces movable past stationary faces closely adjacent thereto and annular sealing means are located between the side faces and the stationary faces in sliding engagement with at least one of the faces to maintain sealing engagement therebetween upon slight, transverse movement of the inner valve member relative to the stationary member.

11. A valve according to claim 9 wherein said side wall ports for conducting exhaust gases from the cylinders are located on the side walls near the circumference thereof in close proximity to the respective cylinder location for immediate removal of exhaust gases therefrom.

12. A valve according to claim 11, wherein said enlarged diameter section includes at least one mixture supply opening registering with said further opening in the outer member once each rotation of the inner valve member, a mixture intake opening into the outer valve member and located intermediate cylinder locations, and a mixture passage from the intake opening in the enlarged diameter section through the enlarged diameter section to the reduced diameter section at the location intermediate cylinders to place in communication the cylinder location and the mixture supply opening.

13. The rotary valve for an internal combustion engine according to claim 9 further comprising substantially annular sealing means mounted between opposed surfaces on the side wall on the enlarged diameter section and an adjacent section, to prevent leakage of gas therebetween, and the opposed surfaces between which the annular sealing means is mounted being substantially parallel to a plane normal to the rotational axis, whereby the sealing ability of the annual sealing means is preserved despite any displacement of the annular sealing means due to combustion pressures.

14. A valve according to claim 13 wherein the rotatable member is formed with an annular groove formed in at least one of the surface portions substantially parallel to a plane normal to the rotational axis and the annular sealing means is mounted within the groove.

15. A valve according to claim 13 wherein the outer stationary support member is formed with an annular groove formed in at least one of the surface portions substantially parallel to a plane normal to the rotational axis and the annular sealing means is mounted within the groove.

16. The rotary valve according to claim 9 wherein a relatively short portion of the dict means formed in the outer support member between the inner valve member and the cylinder location and constituting said further opening is substantially narrower than the cylinder, serves as a portion of said combustion chamber, and includes means immediately adjacent the combustion chamber for the initiation of burning of the compressed fuel-air mixture.

17. A valve according to claim 16 wherein the portion of the duct means serving also as a portion of the combustion chamber has a cross-sectional area that is small as compared to the cross-sectional area of the engine cylinder, said outer member defining means for locating said means for initiating burning directly in the substantially narrower duct means intermediate the inner valve member and the cylinder location, whereby combustion is initiated in the confined area of the small cross-sectional area of the duct means.

18. A valve according to claim 17 wherein the ratio of the smaller area to the larger area is within the range of 1:2 to 1:4.

19. A valve according to claim 17 wherein the boundary between the smaller area and the larger area is delimited by an abrupt step.

* * * * *